US009441836B2

(12) United States Patent
Cohen et al.

(10) Patent No.: US 9,441,836 B2
(45) Date of Patent: Sep. 13, 2016

(54) FUEL-AIR PRE-MIXER WITH PREFILMER

(75) Inventors: Jeffrey M. Cohen, Hebron, CT (US); Zhongtao Dai, Glastonbury, CT (US); Kevin E. Green, Broad Brook, CT (US)

(73) Assignee: United Technologies Corporation, Farmington, CT (US)

( * ) Notice: Subject to any disclaimer, the term of this patent is extended or adjusted under 35 U.S.C. 154(b) by 845 days.

(21) Appl. No.: 13/545,418

(22) Filed: Jul. 10, 2012

(65) Prior Publication Data

US 2014/0013763 A1 Jan. 16, 2014

(51) Int. Cl.
*F23R 3/28* (2006.01)

(52) U.S. Cl.
CPC ..... *F23R 3/28* (2013.01); *F23D 2900/11101* (2013.01)

(58) Field of Classification Search
USPC ..... 60/737–748
See application file for complete search history.

(56) References Cited

U.S. PATENT DOCUMENTS

| | | | | |
|---|---|---|---|---|
| 3,937,011 | A | 2/1976 | Caruel et al. | |
| 3,980,233 | A * | 9/1976 | Simmons et al. | 239/400 |
| 5,603,211 | A | 2/1997 | Graves | |
| 5,613,363 | A | 3/1997 | Joshi et al. | |
| 5,735,681 | A | 4/1998 | Cheng | |
| 5,778,676 | A | 7/1998 | Joshi et al. | |
| 5,879,148 | A | 3/1999 | Cheng et al. | |
| 6,141,967 | A | 11/2000 | Angel et al. | |
| 6,367,262 | B1 * | 4/2002 | Mongia et al. | 60/748 |
| 7,093,445 | B2 | 8/2006 | Corr, II et al. | |
| 7,150,416 | B2 | 12/2006 | Martin et al. | |
| 7,434,401 | B2 | 10/2008 | Hayashi | |
| 7,878,000 | B2 | 2/2011 | Mancini et al. | |
| 8,015,796 | B2 * | 9/2011 | Babu et al. | 60/226.1 |
| 8,171,735 | B2 | 5/2012 | Mancini et al. | |
| 2007/0028624 | A1 | 2/2007 | Hsieh et al. | |
| 2007/0289305 | A1 * | 12/2007 | Oda et al. | 60/748 |
| 2010/0011772 | A1 * | 1/2010 | Gashi | F23D 11/107 60/748 |

FOREIGN PATENT DOCUMENTS

| | | | |
|---|---|---|---|
| EP | 1391652 | A2 | 2/2004 |
| EP | 2221541 | A2 | 8/2010 |
| GB | 2131154 | A | 6/1984 |
| JP | 2005-61715 | | 3/2005 |
| JP | 2005061715 | A * | 3/2005 |

OTHER PUBLICATIONS

International Search Report and Written Opinion for PCT Application No. PCT/US2013/048201 mailed Sep. 25, 2013.

(Continued)

*Primary Examiner* — Craig Kim
(74) *Attorney, Agent, or Firm* — Carlson, Gaskey & Olds, P.C.

(57) ABSTRACT

A fuel-air premixer for a combustor of a gas turbine engine includes a central passage disposed along an axis and operable to communicate a first airflow and an outer annular passage about the axis operable to communicate a second airflow. The fuel-air premixer further includes an inner annular passage about the axis and between the central passage and the outer annular passage for communicating fuel flow. The inner annular passage including an inner exit angled for directing fuel flow toward the axis into a mixer passage downstream of the outer and inner exits for mixing the fuel flow with the first and second airflows.

17 Claims, 4 Drawing Sheets

(56) References Cited

OTHER PUBLICATIONS

U.S. Appl. No. 13/417,380, filed Mar. 12, 2012 "Fuel Air Premixer for Gas Turbine Engine".

International Preliminary Report on Patentability for International Application No. PCT/US2013/048201 mailed on Jan. 22, 2015.

European Search Report for EP Application No. EP13817240.8 dated Jun. 26, 2015.

* cited by examiner

FUEL-AIR PRE-MIXER WITH PREFILMER

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

A combustor generally includes spaced inner and outer liners that define an annular combustion chamber. Arrays of circumferentially distributed combustion air holes penetrate multiple axial locations along each liner to radially admit pressurized air into the combustion chamber. Gas turbine combustors are required to meet aggressive emission requirements. Combustor designs and configurations to lower emissions require a high level of fuel/air mixing to improve combustion and operate at increased combustion temperatures. High combustor temperatures result in shorter auto-ignition times that require fuel/air mixing to occur in a short time.

SUMMARY

A fuel-air premixer for a combustor of a gas turbine engine according to an exemplary embodiment of this disclosure, among other possible things includes a central passage disposed along an axis for a first airflow, an outer annular passage disposed about the central passage and operable to communicate a second airflow through an outer exit into the central passage, at least one of the first and second airflows in non-swirled, an inner annular passage disposed between the central passage and the outer annular passage and operable for communicating a fuel flow into the central passage, the inner annular passage including an inner exit angled for directing fuel flow toward the axis, and a mixer passage downstream of the outer exit and the inner exit for mixing the fuel flow with the first and second airflows.

In a further embodiment of the foregoing fuel-air premixer, includes opening passages communicating fuel to the inner annular passage, the opening passages angled relative to the axis to induce a swirl into fuel flow through the inner annular passage and exiting through the inner exit.

In a further embodiment of any of the foregoing fuel-air premixers, the angle of the opening passages relative to the axis induces a tangential swirl to the fuel flow exiting through the inner exit.

In a further embodiment of any of the foregoing fuel-air premixers, the inner annular passage comprises a baffle for spreading fuel flow exiting through the inner exit.

In a further embodiment of any of the foregoing fuel-air premixers, the outer annular passage includes an outer exit angled for directing the second airflow radially inward toward the axis.

In a further embodiment of any of the foregoing fuel-air premixers, the outer annular channel is configured to provide the second airflow as an unswirled airflow.

In a further embodiment of any of the foregoing fuel-air premixers, the central passage is configured to provide the first airflow as an unswirled airflow.

In a further embodiment of any of the foregoing fuel-air premixers, the mixing passage defines a mixing length forward of the inner exit, the mixing length includes a length for mixing the first and second airflows and the fuel flows to a desired level at a desired fuel flow rate.

In a further embodiment of any of the foregoing fuel-air premixers, the outer exit is axially forward of the inner exit.

In a further embodiment of any of the foregoing fuel-air premixers, includes a first heat shield disposed between the inner annular passage and the outer annular passage and a second heat shield between the central passage and the inner annular passage.

A combustor assembly for a gas turbine engine according to an exemplary embodiment of this disclosure, among other possible things includes a combustion chamber, and a fuel-air mixer in communication with the combustion chamber. The fuel-air mixer includes a central passage disposed along an axis and operable to communicate a first airflow, an outer annular passage disposed about the central passage and operable to communicate a second airflow through an outer exit into the central passage, at least one of the first and second airflows is non-swirled, an inner annular passage disposed between the central passage and the outer annular passage operable for communicating fuel flow into the central passage, the inner annular passage including an inner exit angled for directing fuel flow toward the axis, and a mixer passage downstream of the outer and inner exits for mixing the fuel flow with the first and second airflows.

In a further embodiment of the foregoing combustor assembly, the mixer includes a length spacing the outer and inner exits from the combustion chamber, wherein the length defines a mixing length where fuel from the inner exits mixes with the first and second airflows.

In a further embodiment of any of the foregoing combustor assemblies, includes opening passages communicating fuel to the inner annular passage, the opening passages angled relative to the axis to induce swirl into fuel flow through the inner annular passage and the inner exit.

In a further embodiment of any of the foregoing combustor assemblies, the inner annular passage includes a baffle for spreading fuel flow exiting through the inner exit.

In a further embodiment of any of the foregoing combustor assemblies, the outer annular passage includes an outer exit angled for directing the second airflow radially inward toward the axis.

A gas turbine engine assembly according to an exemplary embodiment of this disclosure, among other possible things includes a fan including a plurality of fan blades rotatable about an axis, a compressor section, a combustor in fluid communication with the compressor section, the combustor including a combustion chamber and fuel-air mixer including a central passage disposed along an axis for a first airflow, an outer annular passage disposed about the central passage and operable to communicate a second airflow through an outer exit into the central passage, an inner annular passage disposed between the central passage and the outer annular passage that is operable for communicating fuel flow into the central passage, the inner annular passage including an inner exit angled for directing fuel flow toward the axis, at least one of the first airflow and the second airflow are non-swirled, and a mixer passage downstream of the outer and inner exits for mixing the fuel flow with the first and second airflows, a turbine section in fluid communication with the combustor, the turbine section driving the compressor section, and a geared architecture driven by the turbine section for rotating the fan about the axis.

In a further embodiment of the foregoing gas turbine engine assembly, the mixer includes a length spacing the outer and inner exits from the combustion chamber, wherein the length defines a mixing length where fuel from the inner exits mixes with the first and second airflows.

In a further embodiment of any of the foregoing gas turbine engine assemblies, includes opening passages for supplying fuel flow to the inner annular passage, the opening passages angled relative to the axis for inducing swirl into the fuel flow exiting through the inner exit.

In a further embodiment of any of the foregoing gas turbine engine assemblies, the inner annular passage comprises a baffle for spreading fuel flow exiting through the inner exit.

In a further embodiment of any of the foregoing gas turbine engine assemblies, the outer annular passage includes an outer exit angled for directing the second airflow radially inward toward the axis.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
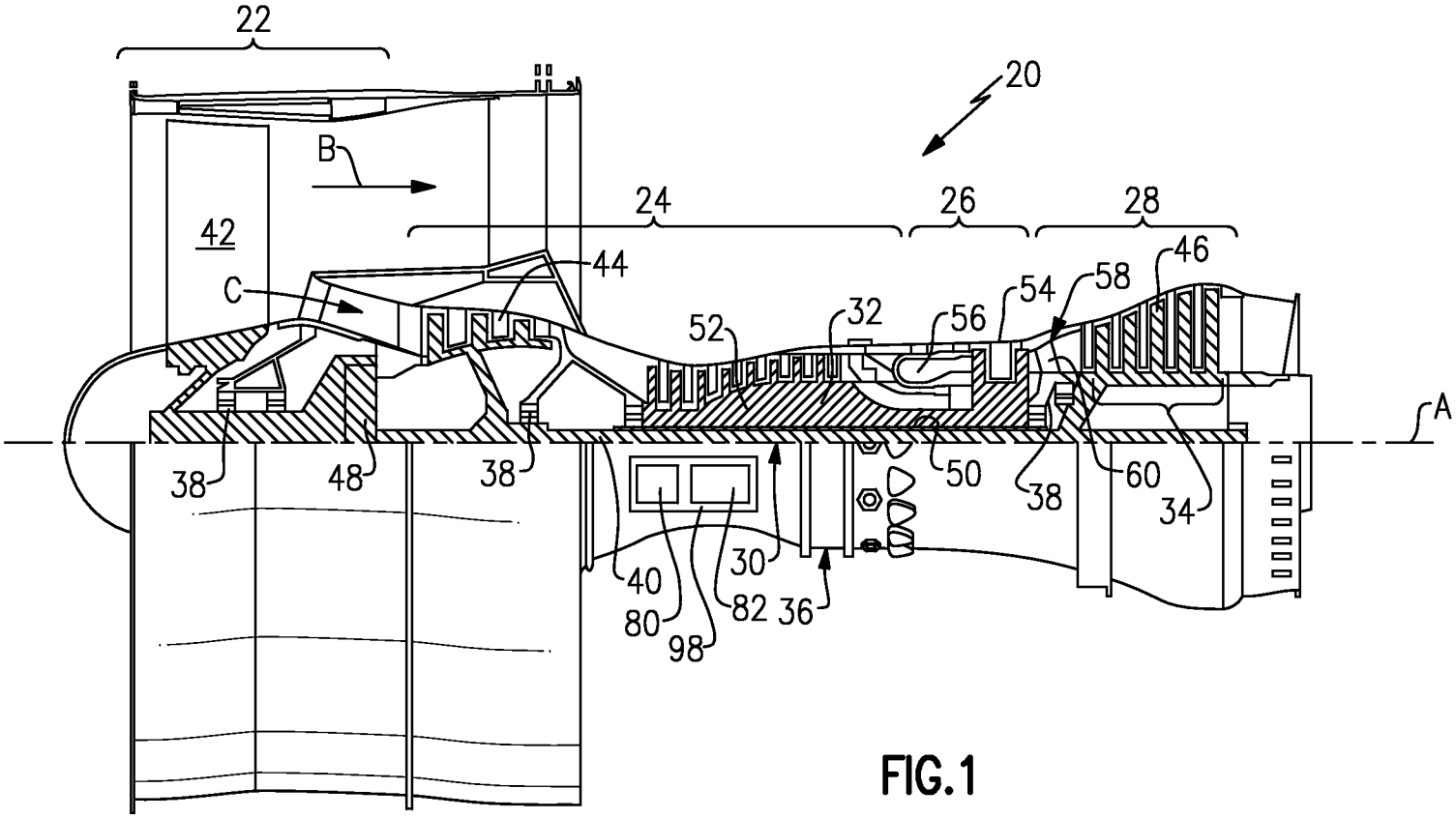
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\text{R})/518.7)^{0.5}]$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low-pressure turbine 46 includes no more than about 6 turbine rotors schematically indicated at 34. In another non-limiting example embodiment, the low-pressure turbine 46 includes about 3 turbine rotors. A ratio between the number of fan blades 42 and the number of low-pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
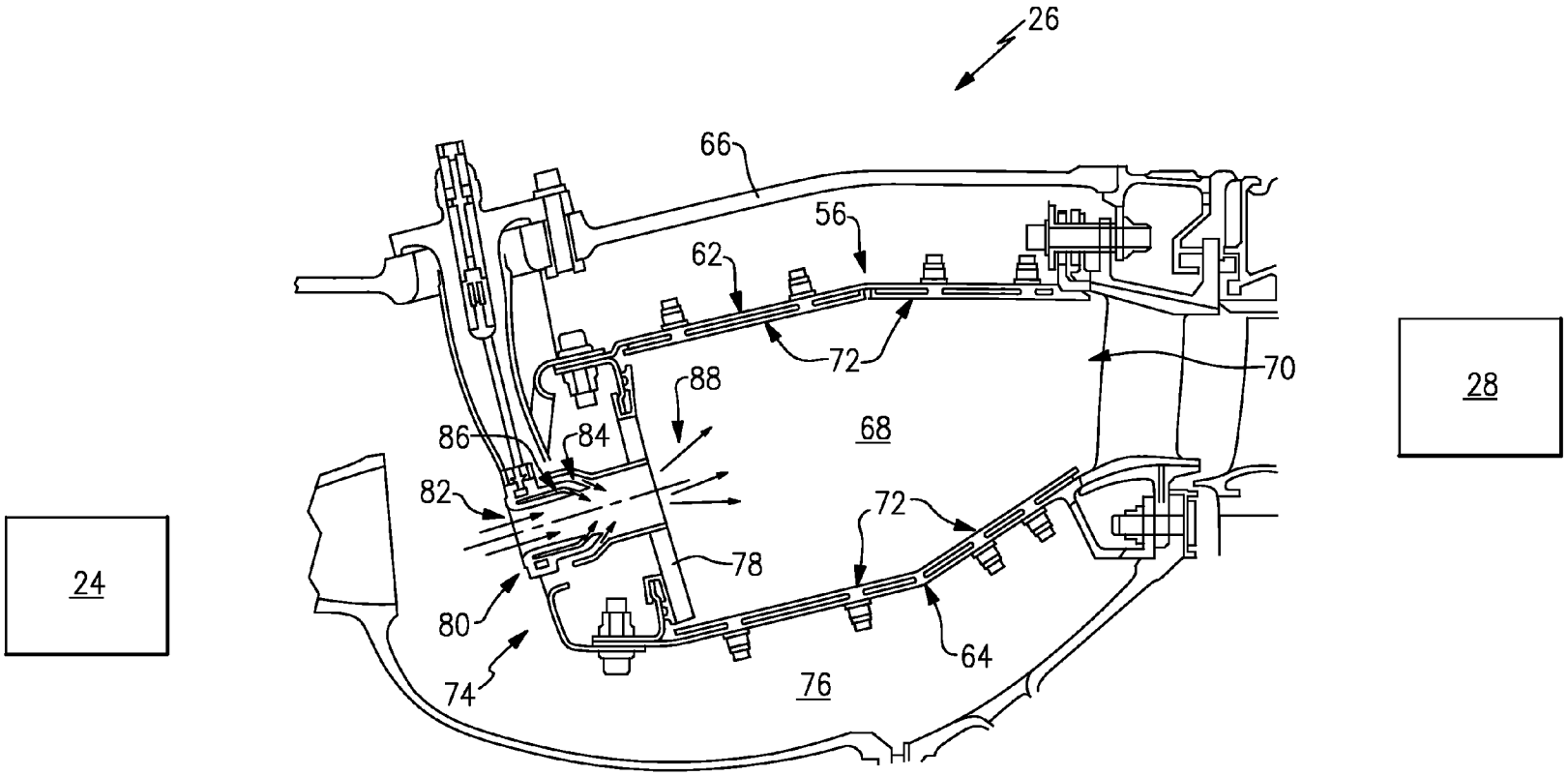
FIG. 2 is a cross-section of an example combustor assembly.

Referring to FIG. 2, the example combustor 56 includes an outer liner 62 and an inner liner 64 that are disposed annularly about the axis A. The outer liner 62 and the inner liner 64 define a chamber 68. A plurality of liner panels 72 define an interior surface of the chamber 68 to withstand pressures and temperatures that are produced during the combustion process. A combustor case 66 supports the combustor 56. A plenum 76 is defined between the case 66 and the outer and inner liners 62, 64. The plenum 76 receives compressed air from the compressor section 24. The example combustor 56 includes an open end 70 and a forward assembly 74. The forward assembly 74 includes a bulkhead 78 that supports a fuel-air mixer 80. The fuel air mixer 80 receives compressed air 82, 84 that is disposed within the plenum 76 and also fuel 86 from a fuel manifold 106, mixes the fuel 86 with the compressed air 82, 84 and communicates the fuel air mixture 88 to the chamber 68. The fuel air mixture 88 is then ignited to generate the high speed hot exhaust gases communicated to drive the turbine section 28.

Figure 3:
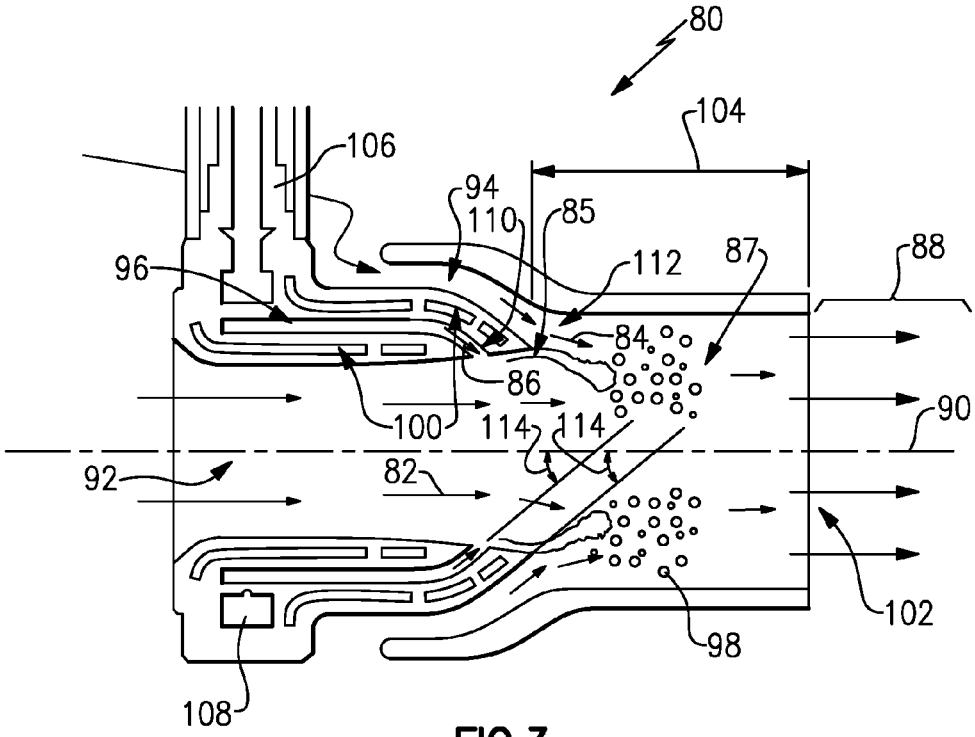
FIG. 3 is a cross-section view of an example fuel air mixer.

Referring to FIG. 3 with continued reference to FIG. 2, the fuel air mixer 80 is disposed generally annularly about an axis 90. A central passage 92 extends about the axis 90 and through the fuel mixer 80. An inner annular passage 96 communicates fuel to the central passage 92. An outer annular passage 94 communicates a second airflow 84 to the central passage 92. A first airflow 82 is communicated through the central passage and mixes with the fuel flow 86 that is communicated through the inner annular passage 96. A second airflow 84 is communicated through the outer annular passage 94 and further mixes with the fuel flow 86 and the first airflow 82.

The inner annular passage 96 includes an exit 110 that provides for the emission of fuel 86 into the central passage 92 at an angle 114 relative to the axis 90. In the disclosed example the angle 114 is approximately 30°. The outer annular passage 94 includes an outer exit 112 that defines an angle 116 relative to the axis 90 for the second airflow 84 to impinge into the central passage 92. In this example the angle 116 is also approximately 30°. As appreciated, the specific angles 114 and 116 that are defined by the corresponding inner and outer annular passages 96, 94 can be adjusted to provide the desired mixing between fuel and air. Moreover, it is within the contemplation of this disclosure that the angles 114, 116 may be adjusted to accommodate application specific performance parameters.

Once the fuel 86 and second airflow 84 are communicated into the central passage 92, they are mixed within a mixer passage 98. The mixer passage 98 includes a length 104 between the exit 112 and an exit 102 of the mixer passage 98. The length 104 is of a determined length to space apart the exits 112 from the incoming second airflow 84 and fuel 86 to provide a sufficient space to ensure a desired level of mixing between the fuel flow 86 and the first and second airflows 82, 84.

Fuel flow 86 exiting the exit 110 in the form of a thin film 85 with little momentum when it enters between the first and second airflows 82, 84. The first and second airflows 82, 84 break the film into droplets 87 that vaporize and mix with the first and second airflows in the mixing passage 98. The first and second airflows 82, 84 do not produce vortices or axially negative flows. The airflows 82, 84 are driven axially through the mixing passage 98.

Mixing within the length 104 is such that the fuel air mixture indicated at 88 exiting the mixing passage 98 enters the combustion chamber 68 at a desired mixture to produce the desired combustion properties. The length 104 is determined based on a time required for mixing the air and fuel in view of a velocity of the first and second air flows 82, 84 and the fuel flow 86.

The example inner annular passage 96 is disposed between heat shields 100 that protect the fuel flow 86 from environmental heat. The inner annular passage 96 generates a thin film of fuel that is communicated through the exit 110 into the central passage 92.

Figure 4:
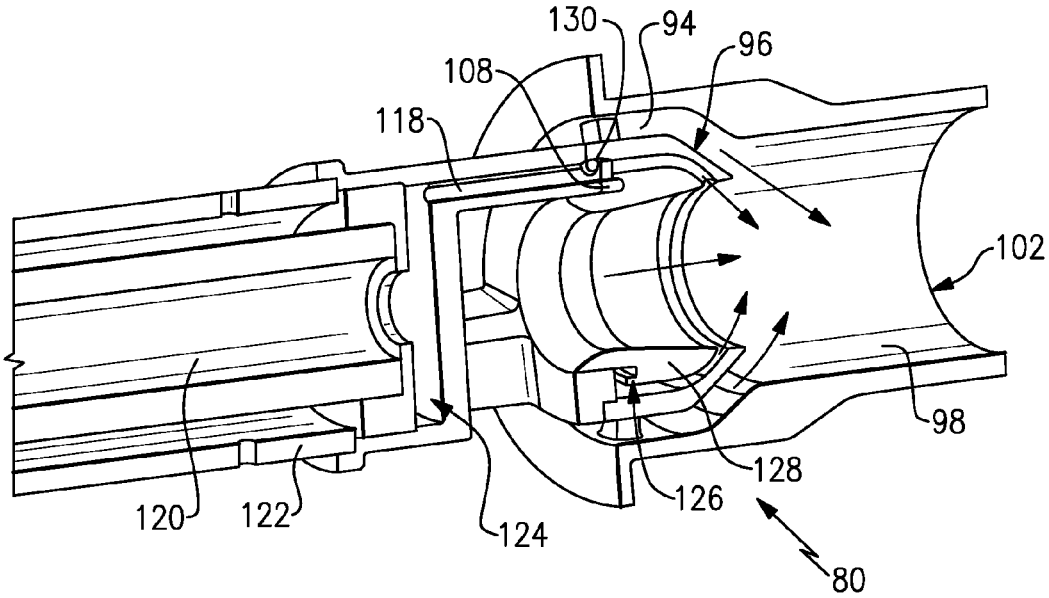
FIG. 4 is a perspective view of an example fuel air mixer.

Referring to FIG. 4 with continued reference to FIG. 2, the example fuel-air mixer 80 includes a nozzle 128 that defines the central portion of the central passage 92 and also a portion of the inner passage 96. The nozzle 128 includes an open end that receives compressed air 75 from the plenum 76. The nozzle 128 also includes an exit that corresponds with an outer wall to define the inner exit 110. The inner annular channel 96 receives fuel through a fuel supply passage 108 in communication with a fuel passage 118 of a fuel manifold 124. The fuel manifold 124 receives fuel from a conduit 120 that is surrounded by a heat shield 122. Fuel is communicated through the conduit 120 into the fuel manifold 124 where it flows through supply passages 118. Supply passages 118 include a plurality of opening passages 130 that communicate fuel to the supply passage 108. The supply passage 108 is an annular channel that is disposed about the nozzle 128 and communicates fuel to the inner annular passage 96. The supply passage 108 includes a lip 126 that provides a baffle that slows and spreads fuel through the exit 110.

Figure 5A:
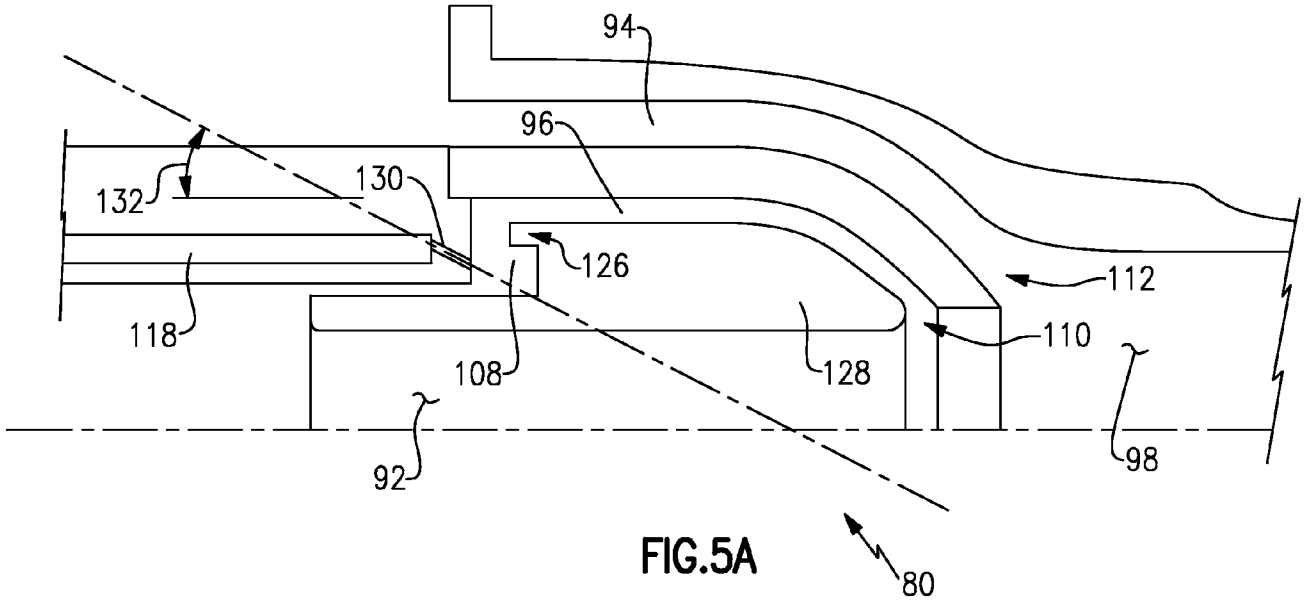
FIG. 5A is a cross-section of the example fuel air mixer.
Figure 5B:
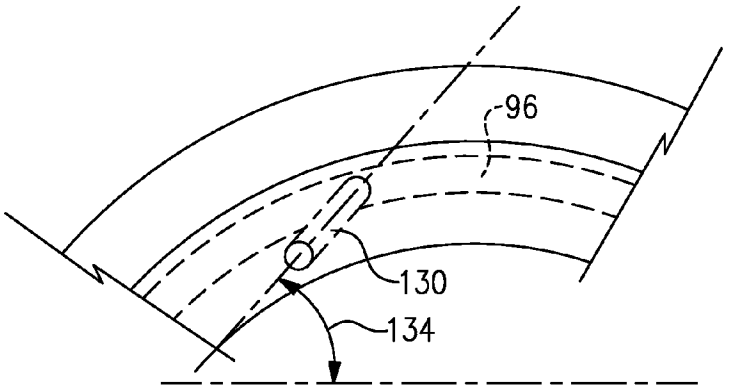
FIG. 5B is a schematic view of an opening passage for fuel flow.

Referring to FIGS. 5A and 5B, the inner annular passage 96 also provides a tangential swirl 115 to the fuel exiting the passage 96. A structure is provided that induces the desired tangential swirl of fuel flow into the mixing passage 98. The tangential swirl is substantially produced by angled opening passages 130 defined between the passage 118 and the annular supply passage 108. The opening passages 130 are angled both radially downward as indicated at 132 and circumferentially and along a yaw axis as indicated at 134 (FIG. 5B). Fuel from the supply passage 118 flows through the opening passages 130 and are directed downwardly and tangentially to induce swirl within the annular supply passage 108. The swirl produced by introducing fuel flow into the passage 108 carries forward into the passage 96 such that fuel flow exiting through the opening 110 enters the mixing passage 98 with the desired radial and swirl components. In this example the opening passages 130 are angled radially inward toward the axis 90 at an angle of about 30°. Moreover, the opening passages 130 are angled in tangentially about 30°. It is within the contemplation of this disclosure that other angles could be utilized to induce the desired amount of swirl to induce mixing. Further, other features and structures could be utilized to generate the swirl in the fuel flow to induce mixing.

Referring to FIGS. 3 and 4, during operation, air is communicated through the central passage 92 without any swirl component, in other words the first airflow 82 through the central passage 92 flows in a substantially axial direction along the axis 90. The second airflow 84 that flows through the outer annular passage 94 also does not include a swirl component but is flowed and communicated into the central passage 92 at the angle 116 inward towards the axis 90. Fuel 86 communicated through the inner annular passage 96 is also angled inward towards the axis 90. The fuel 86 exiting the inner annular passage 96 also includes a tangential swirl component to swirl the fuel relative to the first and second airflows 82, 84. Fuel within the inner annular passage 96 is spread into a thin film along an inner surface of the passage 96. The thin film of fuel 86 is emitted through the exit 110 between the first and second airflows 84 and 82 that surround the exiting fuel 86 and redistributes fuel droplets within the mixing passage 98. The mixing passage 98 is of the length 104 that produces the desired mixing prior to entering the combustion chamber 68 (FIG. 2). Liquid fuel is vaporized by the time it flows through the exit 102 to provide the desired fuel air mixture 88 within the combustion chamber 68.

The example fuel air mixer 80 includes the high pressure first airflow 82 through the central passage 92. The high pressure and velocity of the first airflow 82 of the example pre-mixer 80 provides for the steady flow and mixture of fuel and air into the combustor chamber 68.

Accordingly, the example mixer provides for the desired mixing of fuel within a specific time prior to entering the combustion chamber to provide the desired efficiency and reduction of emissions of the combustion process.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A fuel-air premixer for a combustor of a gas turbine engine comprising:

a central passage disposed along an axis for a first airflow;

an outer annular passage disposed about the central passage and operable to communicate a second airflow through an outer exit into the central passage, wherein at least one of the first and second airflows is non-swirled;

an inner annular passage disposed between the central passage and the outer annular passage and operable for communicating a fuel flow into the central passage, the inner annular passage including an inner exit angled for directing fuel flow toward the axis, wherein the outer exit is axially forward of the inner exit;

a first heat shield disposed between the inner annular passage and the outer annular passage and a second heat shield between the central passage and the inner annular passage; and a mixer passage downstream of the outer exit and the inner exit for mixing the fuel flow with the first and second airflows.

2. A fuel-air premixer for a combustor of a gas turbine engine comprising:

a central passage disposed along an axis for a first airflow;

an outer annular passage disposed about the central passage and operable to communicate a second airflow through an outer exit into the central passage, wherein at least one of the first and second airflows is non-swirled;

an inner annular passage disposed between the central passage and the outer annular passage and operable for communicating a fuel flow into the central passage, the inner annular passage including an inner exit angled for directing fuel flow toward the axis;

opening passages communicating fuel to the inner annular passage, the opening passages angled relative to the axis to induce a swirl into fuel flow through the inner annular passage and exiting through the inner exit; and a mixer passage downstream of the outer exit and the inner exit for mixing the fuel flow with the first and second airflows.

3. The fuel-air premixer as recited in claim 2, wherein the angle of the opening passages relative to the axis induces a tangential swirl to the fuel flow exiting through the inner exit.

4. The fuel-air premixer as recited in claim 3, wherein the inner annular passage comprises a baffle for spreading fuel flow exiting through the inner exit.

5. The fuel-air premixer as recited in claim 1, wherein the outer annular passage includes an outer exit angled for directing the second airflow radially inward toward the axis.

6. The fuel-air premixer as recited in claim 5, wherein the outer annular passage is configured to provide the second airflow as an unswirled airflow.

7. The fuel-air premixer as recited in claim 1, wherein the central passage is configured to provide the first airflow as an unswirled airflow.

8. The fuel-air premixer as recited in claim 1, wherein the mixing passage defines a mixing length forward of the inner exit, wherein the mixing length comprises a length for mixing the first and second airflows and the fuel flows to a desired level at a desired fuel flow rate.

9. A combustor assembly for a gas turbine engine comprising:

a combustion chamber; and a fuel-air mixer in communication with the combustion chamber, the fuel-air mixer including:

a central passage disposed along an axis and operable to communicate a first airflow, an outer annular passage disposed about the central passage and operable to communicate a second airflow through an outer exit into the central passage, wherein at least one of the first and second airflows is non-swirled, an inner annular passage disposed between the central passage and the outer annular passage operable for communicating fuel flow into the central passage, the inner annular passage including an inner exit angled for directing fuel flow toward the axis, wherein the outer exit is axially forward of the inner exit;

a baffle within the inner annular passage for spreading fuel flow exiting through the inner exit; and a mixer passage downstream of the outer and inner exits for mixing the fuel flow with the first and second airflows.

10. The combustor assembly as recited in claim 9, wherein the mixer includes a length spacing the outer and inner exits from the combustion chamber, wherein the length defines a mixing length where fuel from the inner exits mixes with the first and second airflows.

11. A combustor assembly for a gas turbine engine comprising:

a combustion chamber; and a fuel-air mixer in communication with the combustion chamber, the fuel-air mixer including:

a central passage disposed along an axis and operable to communicate a first airflow, an outer annular passage disposed about the central passage and operable to communicate a second airflow through an outer exit into the central passage, wherein at least one of the first and second airflows is non-swirled, wherein the other annular passage includes an outer exit angled for directing the second airflow radially inward toward the axis, an inner annular passage disposed between the central passage and the outer annular passage operable for communicating fuel flow into the central passage, the inner annular passage including an inner exit angled for directing fuel flow toward the axis, opening passages communicating fuel to the inner annular passage, the opening passages angled relative to the axis to induce swirl into fuel flow through the inner annular passage and the inner exit, and a mixer passage downstream of the outer and inner exits for mixing the fuel flow with the first and second airflows.

12. The combustor assembly as recited in claim 11, wherein the inner annular passage includes a baffle for spreading fuel flow exiting through the inner exit.

13. A gas turbine engine assembly comprising:

a fan including a plurality of fan blades rotatable about an axis;

a compressor section a combustor in fluid communication with the compressor section, the combustor including a combustion chamber and fuel-air mixer including a central passage disposed along an axis for a first airflow, an outer annular passage disposed about the central passage and operable to communicate a second airflow through an outer exit into the central passage, an inner annular passage disposed between the central passage and the outer annular passage that is operable for communicating fuel flow into the central passage, the inner annular passage including an inner exit angled for directing fuel flow toward the axis and a baffle for spreading fuel flow exiting through the inner exit, wherein the outer exit is axially forward of the inner exit and angled for directing the second airflow inward toward the axis and at least one of the first airflow and the second airflow is non-swirled, and a mixer passage downstream of the outer and inner exits for mixing the fuel flow with the first and second airflows;

a turbine section in fluid communication with the combustor, the turbine section driving the compressor section; and a geared architecture driven by the turbine section for rotating the fan about the axis.

14. The gas turbine engine assembly as recited in claim 13, wherein the mixer includes a length spacing the outer and inner exits from the combustion chamber, wherein the length defines a mixing length where fuel from the inner exits mixes with the first and second airflows.

15. A gas turbine engine assembly comprising:

a fan including a plurality of fan blades rotatable about an axis;

a compressor section a combustor in fluid communication with the compressor section, the combustor including a combustion chamber and fuel-air mixer including a central passage disposed along an axis for a first airflow, an outer annular passage disposed about the central passage and operable to communicate a second airflow through an outer exit into the central passage, an inner annular passage disposed between the central passage and the outer annular passage that is operable for communicating fuel flow into the central passage, the inner annular passage including an inner exit angled for directing fuel flow toward the axis, wherein at least one of the first airflow and the second airflow is non-swirled, wherein the combustor further includes opening passages for supplying fuel flow to the inner annular passage, the opening passages angled relative to the axis for inducing swirl into the fuel flow exiting through the inner exit, and a mixer passage downstream of the outer and inner exits for mixing the fuel flow with the first and second airflows;

a turbine section in fluid communication with the combustor, the turbine section driving the compressor section; and a geared architecture driven by the turbine section for rotating the fan about the axis.

16. The gas turbine engine assembly as recited in claim 15, wherein the inner annular passage comprises a baffle for spreading fuel flow exiting through the inner exit.

17. The gas turbine engine assembly as recited in claim 13, wherein the outer annular passage includes an outer exit angled for directing the second airflow radially inward toward the axis.

* * * * *